US007229735B2

(12) United States Patent
Pickering et al.

(10) Patent No.: US 7,229,735 B2
(45) Date of Patent: Jun. 12, 2007

(54) TONER COMPOSITIONS

(75) Inventors: Thomas R. Pickering, Webster, NY (US); Louis V. Isganitis, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 291 days.

(21) Appl. No.: 10/899,244

(22) Filed: Jul. 26, 2004

(65) Prior Publication Data

US 2006/0019188 A1 Jan. 26, 2006

(51) Int. Cl.
*G03G 9/08* (2006.01)

(52) U.S. Cl. ..... 430/108.6; 430/108.7; 430/108.1

(58) Field of Classification Search ..... 430/108.6, 430/108.1, 108.7
See application file for complete search history.

(56) References Cited

U.S. PATENT DOCUMENTS

| | | | | |
|---|---|---|---|---|
| 2,871,233 | A | 1/1959 | Pfitzner et al. | |
| 2,891,938 | A | 6/1959 | Schetty | |
| 2,891,939 | A | 6/1959 | Schetty | |
| 2,933,489 | A | 4/1960 | Biedermann et al. | |
| 2,986,652 | A | 5/1961 | Eachus | |
| 3,590,000 | A | 6/1971 | Palermiti et al. | |
| 3,800,588 | A | 4/1974 | Larson et al. | |
| 3,893,935 | A | 7/1975 | Jadwin et al. | |
| 3,944,493 | A | 3/1976 | Jadwin et al. | |
| 4,007,293 | A | 2/1977 | Mincer et al. | |
| 4,053,462 | A | 10/1977 | Beffa et al. | |
| 4,079,014 | A | 3/1978 | Burness et al. | |
| 4,206,064 | A | 6/1980 | Kiuchi et al. | |
| 4,221,856 | A | 9/1980 | Lu | |
| 4,265,990 | A | 5/1981 | Stolka et al. | |
| 4,291,111 | A | 9/1981 | Lu | |
| 4,312,933 | A | 1/1982 | Lu | |
| 4,314,937 | A | 2/1982 | Beffa | |
| 4,338,390 | A | 7/1982 | Lu | |
| 4,394,430 | A | 7/1983 | Jadwin et al. | |
| 4,404,271 | A | 9/1983 | Kawagishi et al. | |
| 4,411,974 | A | 10/1983 | Lu et al. | |
| 4,433,040 | A | 2/1984 | Niimura et al. | |
| 4,558,108 | A | 12/1985 | Alexandru et al. | |
| 4,560,635 | A | 12/1985 | Hoffend et al. | |
| 4,563,408 | A | 1/1986 | Lin et al. | |
| 4,584,253 | A | 4/1986 | Lin et al. | |
| 4,585,884 | A | 4/1986 | Lin et al. | |
| 4,883,736 | A | 11/1989 | Hoffend et al. | |
| 4,904,762 | A | 2/1990 | Chang et al. | |
| 4,935,326 | A | 6/1990 | Creatura et al. | |
| 4,937,166 | A | 6/1990 | Creatura et al. | |
| 5,223,368 | A | 6/1993 | Ciccarelli et al. | |
| 5,304,449 | A | 4/1994 | Hollenbaugh, Jr. | |
| 5,352,556 | A | 10/1994 | Mahabadi et al. | |
| 5,989,768 | A * | 11/1999 | Little | 430/108.24 |
| 6,004,714 | A | 12/1999 | Ciccarelli et al. | |
| 6,017,668 | A | 1/2000 | Young et al. | |
| 6,071,665 | A | 6/2000 | Dickerson et al. | |
| 6,087,059 | A | 7/2000 | Duggan et al. | |
| 6,103,440 | A | 8/2000 | Lohr | |
| 6,124,071 | A | 9/2000 | Lin et al. | |
| 6,383,704 | B1 * | 5/2002 | Kataoka et al. | 430/108.6 |
| 6,420,078 | B1 | 7/2002 | Ciccarelli et al. | |
| 6,610,452 | B2 | 8/2003 | Combes et al. | |
| 6,846,603 | B2 * | 1/2005 | Fujii et al. | 430/108.4 |

FOREIGN PATENT DOCUMENTS

| | | |
|---|---|---|
| GB | 1 442 835 | 7/1976 |

* cited by examiner

*Primary Examiner*—John L Goodrow
(74) *Attorney, Agent, or Firm*—Eugene O. Palazzo; Fay Sharpe LLP

(57) ABSTRACT

A toner composition for use in a xerographic or electrostatographic imaging process. The toner composition includes a toner particle and an optional primary external surface additive and a friable external surface additive. The friable external surface additive may also be a material that is capable of functioning as a primary external surface additive. The friable external surface additive is generally larger than the primary surface additive and capable of having portions of the friable particle broken or abraded off during the imaging process. The particles that are abraded off the friable additive can replace the primary external additive particles that become embedded into toner particles during the development process. The friable additives contribute to reducing toner aging and provide a toner with satisfactory flow and triboelectric properties.

20 Claims, 6 Drawing Sheets

TONER COMPOSITIONS

BACKGROUND

The present disclosure is directed to toner compositions for use in electrostatographic or xerographic processes. More specifically, exemplary embodiments of the present disclosure relate to toner compositions comprising a friable external surface additive. It finds particular application in conjunction with toners and developers for electrostatographic processes, and will be described with particular reference thereto.

In electrophotography, a photoreceptor containing a photoconductive insulating layer on a conductive layer is imaged by first uniformly electrostatically charging its surface. The photoreceptor is then exposed to a pattern of activating electromagnetic radiation, such as light. The radiation selectively dissipates the charge in the illuminated areas of the photoconductive insulating layer while leaving behind an electrostatic latent image. This electrostatic latent image may then be developed to form a visible image. In the development step, charged toner particles are deposited on the photoreceptor surface. There are several techniques by which this can be accomplished, such as charged-area-development (CAD) and discharged-area-development (DAD), most of which involve the use of a second component called a carrier.

In CAD, toner particles are attracted to the charged areas of the photoreceptor. This requires that the polarity of the toner particles be opposite to the photoreceptor surface potential. In DAD, the toner polarity is the same as the photoreceptor surface. As a result, the toner particles are repelled from the charged areas of the photoreceptor and deposit in the discharged regions. This requires the use of a developer housing bias with the same polarity as the photoreceptor surface potential.

By utilizing either process, the resulting visible image may then be transferred from the photoconductor to a support, such as transparency or paper. This imaging process may be repeated many times.

Various toner compositions for such imaging processes are well known in the art, and have been produced having a wide range of additives and constituent materials. Generally, however, the toner compositions or particles include a binding material such as a resin, a colorant such as a dye and/or a pigment, and any of various additives to provide particular properties to the toner particles.

The use of external additives in toner and developer compositions to improve a variety of characteristics in such compositions is known in the art. One type of additive that is commonly used in toner compositions is a surface additive. For example, surface additives may be incorporated to improve triboelectric charging behavior of the toners or developers, to improve the flow properties of the toner, and to improve development and transfer performance of the toner. An example of an external surface additive known in the art is hydrophobic fumed silica.

The primary particle size of surface additives, such as fumed silica, ranges from a few nanometers to tens of nanometers. However, these primary particles group together to form larger aggregates.

Developer compositions with charge enhancing additives, which impart a positive charge to the toner resin, are also known. For example, U.S. Pat. No. 3,893,935 describes the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide. Similar teachings are presented in U.S. Pat. Nos. 4,312,933 and 4,291,111. There is also described in U.S. Pat. No. 2,986,521 developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the entire disclosure of which is incorporated herein by reference, developer compositions containing as charge enhancing additives organic sulfate and sulfonates, which additives can impart a positive charge to the toner composition. Further, there is disclosed in U.S. Pat. No. 4,298,672, the entire disclosure of which is incorporated herein by reference, positively charged toner compositions with resin particles and pigment particles, and as charge enhancing additives alkyl pyridinium compounds.

Additionally, other patents disclosing positively charged toner compositions with charge control additives include, for example, U.S. Pat. Nos. 3,944,493; 4,007,293; 4,079,014; 4,394,430 and 4,560,635, which illustrate a toner with a distearyl dimethyl ammonium methyl sulfate charge additive. Surface additives, such as silicas like AEROSILS™, may be incorporated into the toners of these patents.

Moreover, toner compositions with negative charge enhancing additives are known, as described, for example, in U.S. Pat. Nos. 4,411,974 and 4,206,064, the entire disclosures of which are incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

U.S. Pat. No.4,404,271 describes a toner that contains a metal complex where the metal can be chromium, cobalt or iron. Additionally, other patents disclosing various metal containing azo dyestuff structures wherein the metal is chromium or cobalt include U.S. Pat. Nos. 2,891,939, 2,871,233, 2,891,938, 2,933,489, 4,053,462 and 4,314,937. Also, in U.S. Pat. No. 4,433,040, the entire disclosure of which is incorporated herein by reference, there are illustrated toner compositions with chromium and cobalt complexes of azo dyes as negative charge enhancing additives. Other charge enhancing additives include those illustrated in U.S. Pat. Nos. 5,304,449, 4,904,762, and 5,223,368, the entire disclosures of which are incorporated herein by reference.

One of the problems associated with the use of external additives is that the improvements associated with the use of such additives may be lost when the additives become embedded into the toner particles surface as a result of mechanical forces encountered in the development hardware of the electrostatographic or xerographic machines. In high speed, high capacity systems, for example, long print runs with relatively low area coverage of color printing can cause the toner in the color developer housings to encounter long residence times and the resulting embedding of the external additives used in the system. As the external surface additives become embedded in the toner particle surface, the triboelectric and flow characteristics of the developer may decrease. This will result in poor development and poor transfer characteristics. Thus, embedding of the external additives into the toner particles decreases the effective life of the toner and/or developer, i.e., contributes to aging the toner and/or developer.

Attempts to solve the problem of toner aging in systems employing external additives have focused on a wide variety of parameters. Problems associated with the embedding of external additives into the toner surface have been addressed by selections of the type, size, and concentration of external additives used in toner and developer compositions. Attempts to reduce the aging of toners and developers have also focused on the blending techniques used to form toner compositions. The way in which an external surface additive is blended on the toner has a great effect on the performance of the system. If the blending is too gentle, the additive will not attach well to the toner surface, and the additive may collect in places that result an undesirable machine performance. Blending too aggressively, however, causes the additive to embed into the surface of the toner, which results in a loss of the beneficial effects of the external additive.

Despite the broad range of additives that have been used in formulating toner compositions, there is a continued need in the art for improved toner compositions that provide improved results and improved image quality. Consequently, it is desirable to provide a toner composition that will not suffer from the detrimental effects associated with conventional external additives that result from external additive particles embedding into toner particles. It is desirable to provide a toner and/or developer composition that has a longer life as compared to toners or developers using conventional external additives. It is also desirable to provide a toner employing an external additive that does not exhibit high relative humidity sensitivity. It is further desirable to provide a toner that is more robust relative to previous toners with respect to aging in developer housings due to being subjected to mechanical forces. It is still further desirable to provide an additive for a toner, and a toner using such an additive, that offers improved flow properties, prevents agglomeration, and extends the life of the toner while providing satisfactory triboelectric characteristics to the toner.

BRIEF DESCRIPTION

The present disclosure relates to exemplary embodiments that achieve one or more of the foregoing and provide, in one aspect, a toner composition for an electrostatographic process. The toner composition comprises a toner particle and a friable external additive. Optionally, a primary external additive may also be included.

The present exemplary embodiment also provides, in another aspect, a developer for an electrostatographic process that comprises a carrier and a toner composition comprising a toner particle, a primary external additive, and a secondary external additive. The secondary external additive is a friable external additive adapted to replace the primary additive as the primary additive is embedded into the surface of the toner particle during an electrostatographic process.

In still another aspect, the present exemplary embodiment provides a toner composition comprising a binder, a colorant, and a combination of a primary surface additive and a friable surface additive, wherein the friable surface additive has a particle size larger than the particle size of the primary surface additive.

These and other non-limiting aspects and/or objects of the development are more particularly disclosed below.

BRIEF DESCRIPTION OF THE DRAWINGS

The following is a brief description of the drawings, which are presented for the purposes of illustrating the development disclosed herein and not for the purposes of limiting the same.

DETAILED DESCRIPTION

Figure 1:
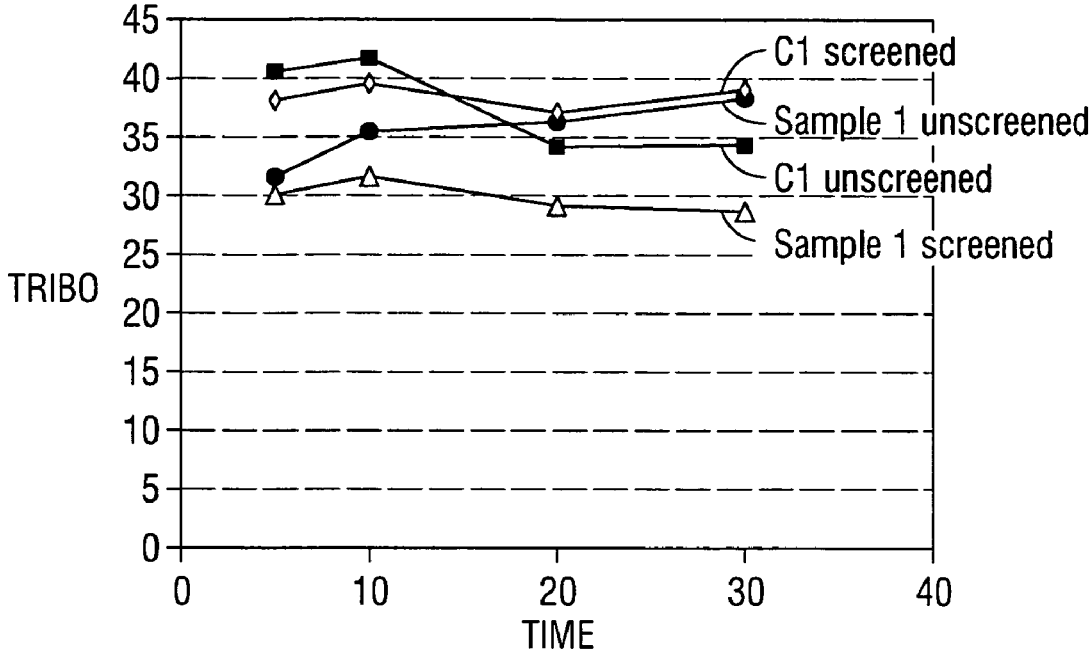
FIG. 1 is graph comparing the triboelectric charge over time for screened and unscreened compositions of Sample 1 and Control 1.
Figure 2:
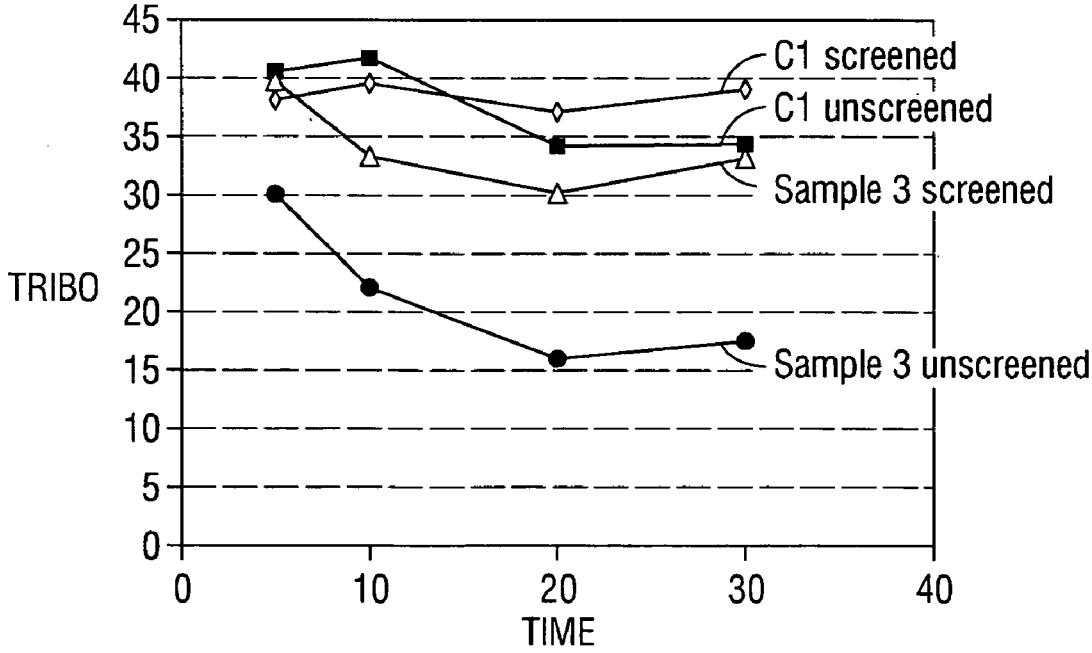
FIG. 2 is a graph comparing the triboelectric charge over time for screened and unscreened toner compositions of Sample 3 and Control 1.
Figure 3:
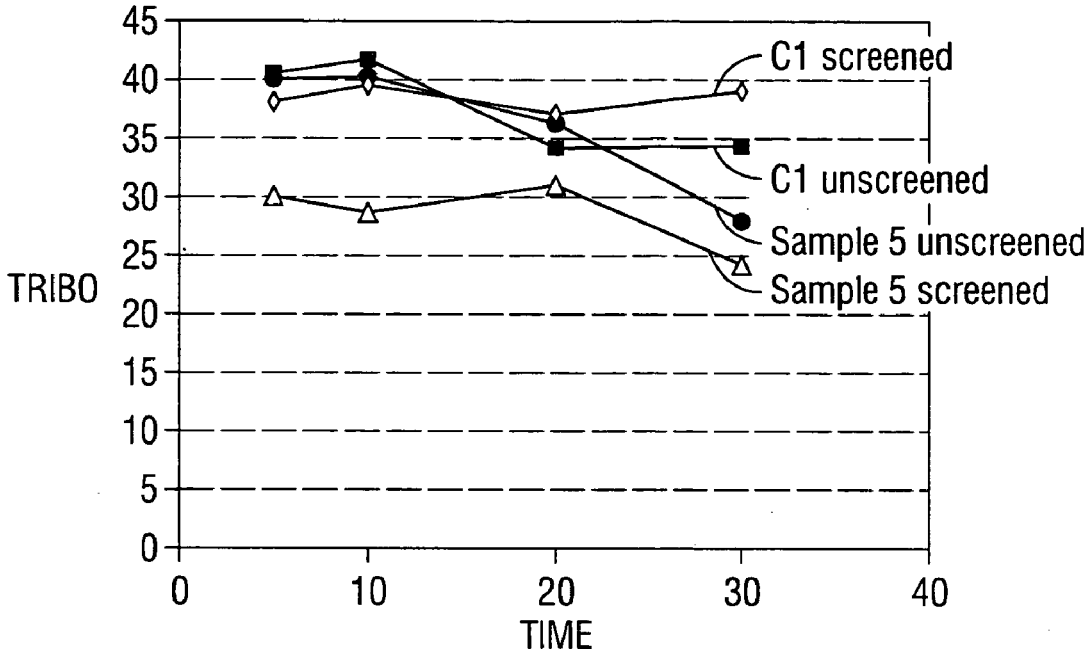
FIG. 3 is a graph comparing the triboelectric charge over time for unscreened and screened toner compositions of Sample 5 and Control 1.
Figure 4:
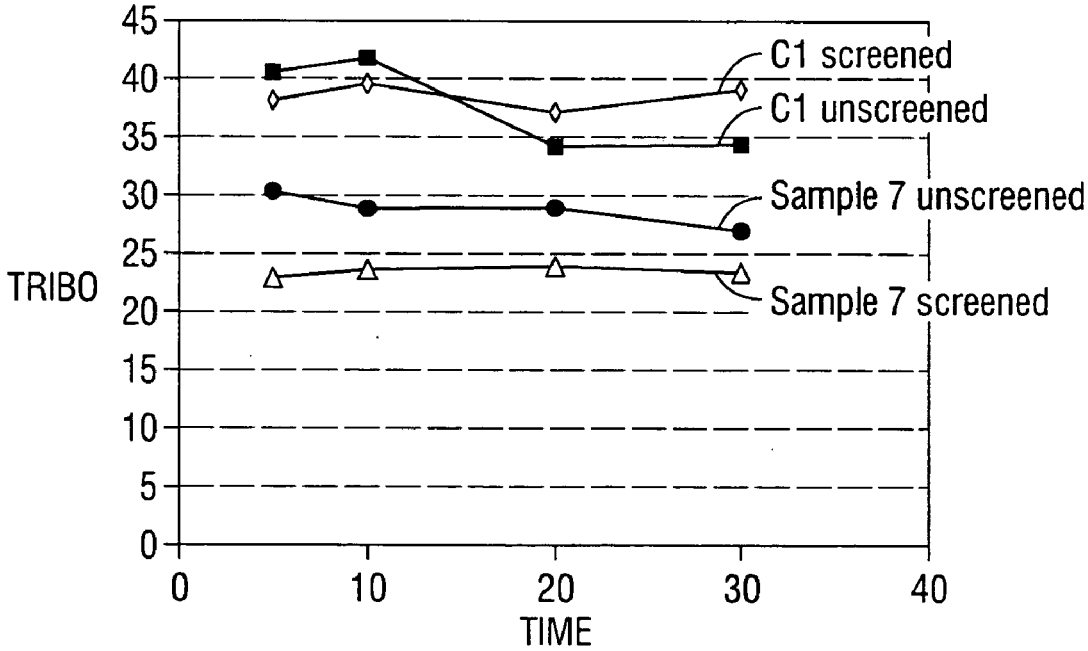
FIG. 4 is graph comparing the triboelectric charge over time for screened and unscreened toner compositions of Sample 7 and Control 1.

The present exemplary embodiments provide toner compositions comprising a toner particle, an optional primary external additive and a friable external additive. The primary external additive may be any external surface additive, as the term is known in the art, which may improve at least one of the flow, triboelectric, or development or transfer performance of the toner and/or developers. Examples of suitable primary external surface additives include, but are not limited to, metal oxides selected from the group of silica, alumina, ceria, germania, titania, zirconia and mixtures thereof. The metal oxide may be a fumed, cofumed or precipitated material, or a gel processed material including for example, aerogels, silica gels, xerogels, hydrogels and the like.

Examples of these primary external additives which produce one or more of the above characteristics include colloidal silicas, such as AEROSIL®, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

Other examples of suitable primary surface additives include sol-gel silica or sol-gel metal oxides described in U.S. Pat. No. 6,610,452, or alumina particles treated with a treatment agent as described in U.S. Pat. No. 6,420,078, the disclosures of which are incorporated herein by reference.

In embodiments, the surface additive is an aerogel. In further embodiments, the surface additive is an aerogel that is made hydrophobic. Aerogels may be made hydrophobic by treating the aerogel with various agents while the material is in the liquid state. The primary surface additives generally have a primary particle size in the range of from about 5 to about 500 nanometers.

A friable additive or friable surface additive, as used herein, is a material that is suitable as an additive in a toner composition and is capable of having particles abraded off the material by the same mechanical forces that cause the primary additive particles to embed into the toner particles. Generally, the friable additive is much larger in size relative to the primary additive or larger than the flow/charge additive that it is replacing. In some embodiments, the friable additive is a much larger, breakable or abradeable form of the primary additive being used in the toner. Thus, suitable friable additives include those materials, previously described herein, that are suitable as the primary surface additive.

In certain embodiments, the friable additive is an aerogel, and may be a silica aerogel. Examples of materials suitable as the friable additive include, but are not limited to, aerogels available from Cabot, Billerica, Mass., under the tradename NANOGEL®. Small, broken bits of an aerogel structure may cling together to form agglomerates, just as aggregates, i.e., roughly spherical "primary particles" of materials such as fumed silica that are permanently sintered together, come together to form agglomerates in fumed silicas. With respect to aerogels, however, there is no limit to the size that the original network structure can be broken down into. Particles from the aerogel can become as small as the forces breaking the network structure allow. While not being bound to any particular theory, the size and size distribution of the particles from an aerogel may contribute to the excellent flow properties observed in the toners into which aerogels are incorporated. The aerogels may also be made hydrophobic which may make the toner less sensitive at high humidities.

The friable additive may be present in the toner composition in an amount of greater than 0 to about 10 percent by weight of the toner composition. In embodiments, the friable surface additive is present in an amount greater than 0 to about 5 percent by weight of the toner composition. The primary additive may be present in the toner composition in an amount of about 0.1 to about 10 percent by weight of the toner composition. In some embodiments, the primary additive and the friable additive are present in the same concentration.

As previously described, the friable additive is larger in size relative to the optional primary additive. Primary surface additives typically have a primary particle size in the range of about 5 to about 500 nanometers. In embodiments, the friable surface additives have a particle size in the range of greater than 5 nanometers to about 5 mm.

The present toner compositions, in addition to including the above-described combination of a primary external surface additive and a friable additive, generally also include at least a toner resin particle and a colorant. In addition, the toner compositions can include one or more conventional additives, including but not limited to, optional charge enhancing additives and optional waxes, especially low molecular weight waxes with an Mw of, for example, from about 1,000 to about 20,000.

Suitable toner compositions, which can be modified to include a combination of a primary external surface additive and a friable additive, include those toner compositions disclosed in, for example, U.S. Pat. Nos. 6,004,714, 6,017,668, 6,071,665, 6,087,059, 6,103,440, and 6,124,071, the entire disclosures of which are incorporated herein by reference. The toner compositions can generally be prepared by any known technique, such as by admixing and heating resin particles, colorant, and optional additives other than the above-described surface additives in a suitable toner extrusion device, such as the ZSK53 available from Werner Pfleiderer, followed by removing the formed toner composition from the device. Subsequent to cooling, the toner composition is subjected to grinding utilizing, for example, a Sturtevant micronizer for the purpose of achieving toner particles with a desired volume median diameter of, for example, less than about 25 microns, and preferably of from about 6 to about 12 microns, which diameters are determined by a Coulter Counter.

Subsequently, the toner compositions can be classified utilizing, for example, a Donaldson Model B classifier for the purpose of removing fines, i.e., toner particles having a volume median diameter of less than about 4 microns. Thereafter, the primary external additive and the friable additive can be added to the toner composition by blending the additives with the obtained toner particles.

As the toner (or binder) resin, any of the conventional toner resins can be used. Illustrative examples of such suitable toner resins include, for example, thermoplastic resins such as vinyl resins in general or styrene resins in particular, and polyesters. Examples of suitable thermoplastic resins include, but are not limited to, styrene methacrylate; polyolefins; styrene acrylates, such as PSB-2700 obtained from Hercules-Sanyo Inc.; polyesters, styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol. Other suitable vinyl monomers include, but are not limited to, styrene; p-chlorostyrene; unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, and acrylamide; mixtures thereof; and the like. In addition, crosslinked resins, including polymers, copolymers, and homopolymers of styrene polymers, may be selected.

For example, as one toner resin, there can be selected the esterification products of a dicarboxylic acid and a diol comprising a diphenol. These resins are illustrated, for example, in U.S. Pat. No. 3,590,000, the entire disclosure of which is incorporated herein by reference. Other specific toner resins include, but are not limited to, styrene/methacrylate copolymers, and styrene/butadiene copolymers; Pliolites; suspension polymerized styrene butadienes, reference U.S. Pat. No. 4,558,108, the entire disclosure of which is incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol; reactive extruded resins, especially reactive extruded polyesters with crosslinking as illustrated in U.S. Pat. No. 5,352,556, the entire disclosure of which is incorporated herein by reference, styrene acrylates, and mixtures thereof. Also, waxes with a molecular weight Mw of from about 1,000 to about 20,000, such as polyethylene, polypropylene, and paraffin waxes, can be included in, or on the toner compositions as fuser roll release agents.

The toner resin is generally present in any sufficient, but effective amount. For example, the toner resin is generally present in an amount of from about 50 to about 95 percent by weight of the toner composition. More preferably, the toner resin is generally present in an amount of from about 70 to about 90 percent by weight of the toner composition.

The toner composition also generally includes a colorant. As desired, the colorant can be a dye, a pigment, a mixture of a dye and a pigment, or two or more of them. As colored pigments, there can be selected, for example, various known cyan, magenta, yellow, red, green, brown, or blue colorants, or mixtures thereof. Specific examples of pigments include, but are not limited to, phthalocyanine HELIOGEN BLUE L6900®, D6840®, D7080®, D7020®, PYLAM OIL BLUE®, PYLAM OIL YELLOW®, PIGMENT BLUE 1®, available from Paul Uhlich & Company, Inc., PIGMENT VIOLET 1®, PIGMENT RED 48®, LEMON CHROME YELLOW DCC 1026®, E.D. TOLUIDINE RED® and BON RED C® available from Dominion Color Corporation, Ltd., Toronto, Ontario, NOVAPERM YELLOW FGL®, HOSTAPERM PINK E® from Hoechst (now Clariant), CINQUASIA MAGENTATA® available from E.I. DuPont de Nemours & Company, Pigment Yellow 180, Pigment Yellow 12, Pigment Yellow 13, Pigment Yellow 14, Pigment Yellow 17, Pigment Blue 15, Pigment Blue 15:3, Pigment Red 122, Pigment Red 57:1, Pigment Red 81:1, Pigment Red 81:2, Pigment Red 81:3, and the like.

Generally, colored dyes and pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy4-sulfonanilide phenylazo-4'-chloro-2,5-dimethoxy acetoacetanilide, and Permanent Yellow FGL. Other soluble dyes, such as red, blue, green, and the like, can also be used, as desired.

Generally, the colorant is included in the toner composition in known amounts, for the desired color strength. For example, the above-described dyes and pigments, and others, can be included in the toner composition in any suitable amount, such as from about 1 to about 20 percent by weight of the toner composition. Preferably, the colorant is included in an amount of from about 2 to about 10 percent by weight of the toner composition.

If desired, such as to give the toner composition magnetic properties, magnetites can also be included in the toner composition, either for their magnetic properties, or for the colorant properties, or both. Suitable magnetites that can be used in the toner compositions of the present disclosure include, but are not limited to, a mixture of iron oxides (FeO, $Fe_2O_3$), including those commercially available as MAPICO BLACK®. The magnetite can be present in the toner composition in any of various effective amounts, such as an amount of from about 10 percent by weight to about 75 percent by weight of the toner composition. Preferably, the magnetite is present in an amount of from about 30 percent to about 55 percent by weight of the toner composition.

There can be included in the toner compositions of the present disclosure charge additives as indicated herein in various effective amounts, such as from about 1 to about 15, and preferably from about 1 to about 3, percent by weight of the toner composition. Such suitable charge additives can include coated alumina, silica, titania and other charge additives well known in the art.

Furthermore, the toner compositions of the present disclosure can also include suitable waxes for their known effect. Suitable waxes include, but are not limited to, polypropylenes and polyethylenes commercially available from Allied Chemical and Petrolite Corporation; Epolene N-15 commercially available from Eastman Chemical Products, Inc.; Viscol 550-P, a low weight average molecular weight polypropylene available from Sanyo Kasei K.K.; mixtures thereof, and the like. The commercially available polyethylenes selected possess, for example, a weight average molecular weight of from about 1,000 to about 1,500, while the commercially available polypropylenes utilized are believed to have a weight average molecular weight of from about 4,000 to about 7,000. Many of the polyethylene and polypropylene compositions useful in the present disclosure are illustrated in British Patent No. 1,442,835, the entire disclosure of which is incorporated herein by reference.

The wax can be present in the toner composition of the present disclosure in various amounts. However, generally these waxes are present in the toner composition in an amount of from about 1 percent by weight to about 15 percent by weight, and preferably in an amount of from about 2 percent by weight to about 10 percent by weight, based on the weight of the toner composition.

The toners of the present disclosure may also, in embodiments, contain polymeric alcohols, such as UNILINS®, reference U.S. Pat. No. 4,883,736, the entire disclosure of which is incorporated herein by reference. The UNILINS® products are available from Petrolite Corporation.

The present toner compositions may also be used in developers used in electrostatographic or xerographic processes. The toners may be used in either single component or two component development systems. Two component developer compositions can be prepared by mixing the present toners with known carrier particles, including but not limited to coated carriers, such as steel, ferrites, and the like, reference U.S. Pat. Nos. 4,937,166 and 4,935,326, the entire disclosures of which are incorporated herein by reference. The toner composition and carrier particles are generally mixed to include from about 2 percent toner concentration to about 8 percent toner concentration. The carriers can include coatings thereon, such as those illustrated in the above-referenced U.S. Pat. Nos. 4,937,166 and 4,935,326 patents, and other known coatings. There can be selected a single coating polymer, or a mixture of polymers. Additionally, the polymer coating or coatings may contain conductive components therein, such as carbon black in an amount for example, of from about 10 to about 70 weight percent, and preferably from about 20 to about 50 weight percent. Specific examples of coatings are fluorocarbon polymers, acrylate polymers, methacrylate polymers, silicone polymers, and the like.

Imaging methods are also envisioned with the toners of the present disclosure. Suitable imaging methods that utilize toner particles are known in the art and include, for example, but are not limited to, the various patents mentioned herein as well as U.S. Pat. Nos. 4,585,884, 4,584,253, 4,563,408, and 4,265,990, the entire disclosures of which are incorporated herein by reference.

In embodiments of the present disclosure, the toner compositions have a triboelectric charge of from about 15 to about 70 microcoulombs per gram. Preferably, the toner compositions have a triboelectric charge of from about 25 to about 65 microcoulombs per gram, more preferably from about 30 to about 60 microcoulombs per gram.

The present toners, employing a primary additive and a friable additive as described herein, exhibit satisfactory flow properties, triboelectric charging, as well as satisfactory development and transfer performance. The present toners also offer a toner with reduced aging, i.e., a longer effective life, compared to toners using only a primary surface additive. The friable additives provide improved toner aging because the friable additives provide a way to replenish the additive within a toner system. While not being bound to any particular theory, the mechanical forces that cause the primary additives to embed into the toner particle also cause a portion of the friable additive to abrade off, thereby replacing the embedded primary additive material with another additive material in the toner composition. Thus, the degradation of properties normally caused by additive embedding is avoided by the continuous generation of new particles as the friable additive, such as an aerogel, is broken apart.

The present exemplary embodiments are further understood with reference to the following examples. The examples are merely illustrative of the present exemplary embodiment and not intended to limit the present exemplary embodiment in any manner.

EXAMPLES

Example I

Effect of Friable External Toner Additives on Properties of Toner

To determine the effects that friable additives have on the properties of toner compositions, several toner compositions comprising friable additives were prepared and various properties of those compositions were compared to a control toner composition comprising a conventional primary additive. The properties examined included the visible physical properties of the toner composition, and the triboelectric properties of the composition. The visible physical properties observed included the flow of the composition.

Control samples were prepared using a base (no additive) toner and blending a standard commercially available silica such as RY-50 available from DeGussa onto the surface. Control sample 1 (C1) was a toner composition having 1% by weight of the silica additive RY-50. Control sample 2 (C2) was a toner composition having 4% by weight of the silica additive RY-50.

Toner samples including friable additives were prepared using different materials under the tradename NANOGEL® available from Cabot. The sample toner compositions were prepared by blending a black classified toner with friable additives in amounts of 1% and 4% by weight. Table 1 sets forth the make up of the sample toner compositions that included the friable additives.

TABLE 1

| Sample | Make-Up/Additive | Sample Code | Product Code |
|---|---|---|---|
| 1 | 1% NANOGEL ® Aerogel Beads (1 mm beads) | O1N | OP0010 |
| 2 | 4% NANOGEL ® Aerogel Beads (1 mm beads) | O1N | OP0010 |
| 3 | 1% NANOGEL ® Fine Particle Aerogel (8 microns) | O2N | OJ0008 |
| 4 | 4% NANOGEL ® Fine Particle Aerogel (8 microns) | O2N | OJ0008 |
| 5 | 1% NANOGEL ® IR Opacified Beads (1 mm beads) | O3N | OR0010 |
| 6 | 4% NANOGEL ® IR Opacified Beads (1 mm beads) | O3N | OR0010 |
| 7 | 1% NANOGEL ® Translucent Aerogel (2 mm granules) | O4N | TL0534 |
| 8 | 4% NANOGEL ® Translucent Aerogel (2 mm granules) | O4N | TL0534 |

Each of the control and test samples was prepared as follows. Additives in the desired amount were blended onto 75 grams of toner using a Kyoritsu Sample Mill, Model SKM-10. The mixture was blended at 13,000 RPM for 30 seconds on, blending was stopped for a 30 second rest period, and then the mixture was blended again for another 30 seconds for a total blend time of 60 seconds. Half of each blended sample was sieved through a 45 micron screen to remove excess, unblended additive.

After blending, the blends settled to form some packing. Stirring was required to make the blends flow.

After initially breaking up the packed toner, some observable physical properties were examined. The samples were stirred with a spatula, and observations were made as to how the sample flowed when stirred (after the initial break up of the packed toner) and how well the toner fell of the spatula. Following the flow observations, the physical appearance of the blend was observed under a microscope using at least 7× power and on some occasions under 30× power. Table 2 contains the observations from the above tests.

TABLE 2

Physical Observations of Toners

| Sample | Observations |
|---|---|
| C1 | Blend had a rough look when stirred. Sample on spatula caked and peeled off when dumped. Small white specs of additive were visible at 7×. |
| C2 | Blend had a rough look when stirred. Sample on spatula caked and peeled off when dumped. Small white specs of additives were visible at 7×. |
| 1 | Flowed and stirred better than C1. Some not so obvious chunks of additive were observed. |
| 2 | Visible white chunks observed before stirring, flowed off spatula better than C2; stirred almost like water. Under magnification, the chunks broke up into smaller chunks. |
| 3 | Stirred better than C1 or C2, but flows about the same. No visible additive chunks were observed with or without magnification. |
| 4 | Stirred better than C1 or C2. Flowed better than C1 or C2. Flowed slightly better than Sample 2, but not quite as good as Sample 8. No additive chunks or specs visible with or without |

TABLE 2-continued

| Physical Observations of Toners | |
|---|---|
| Sample | Observations |
| | magnification. |
| 5 | Stirred better than C1 or C2, flows slightly better than or equal to C1 or C2. No visible chunks observed without magnification. Additive chunks visible under magnification. |
| 6 | Stirred better than C1 or C2, but flows about the same. White chunks visible in the sample without magnification. Chunks were very obvious under magnification; observed that chunks were easy to break up into smaller chunks. |
| 7 | Flowed better or at least equal to C1, but not quite as good as Sample 1. |
| 8 | Stirred and flowed better than C1 or C2, but not as well as Sample 2. No obvious additive chunks without magnification. Sample didn't seem to pack as hard as other samples. Under magnification some black chunks were observed and appeared to be additive chunks covered with toner that would not easily come off; these chunks were difficult to break up with spatula or needle. |

Figure 5:
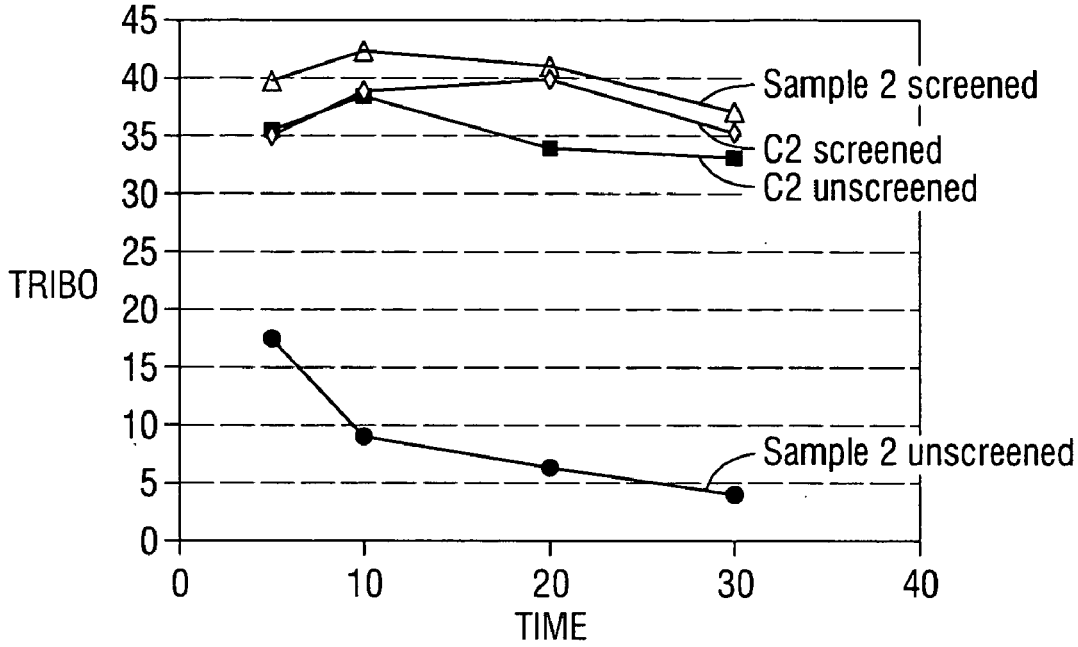
FIG. 5 is a graph comparing the triboelectric charge over time for screened and unscreened toner compositions of Sample 2 and Control 2.
Figure 6:
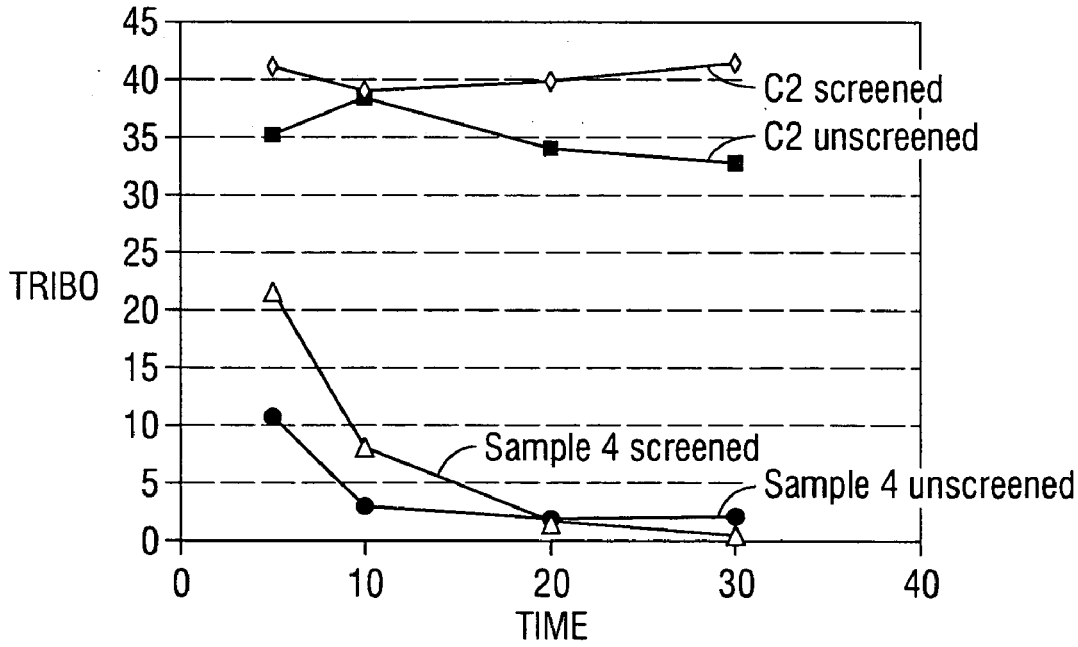
FIG. 6 is a graph comparing the triboelectric charge over time for screened and unscreened toner compositions of Sample 4 and Control 2.
Figure 7:
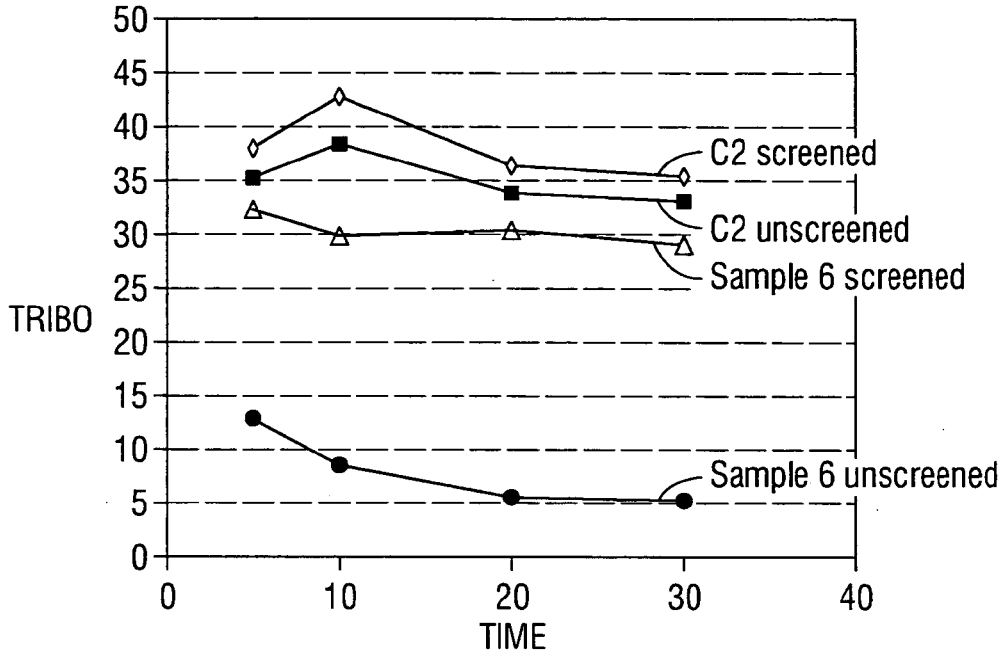
FIG. 7 is a graph comparing the triboelectric charge over time for screened and unscreened toner compositions of Sample 6 and Control 2.
Figure 8:
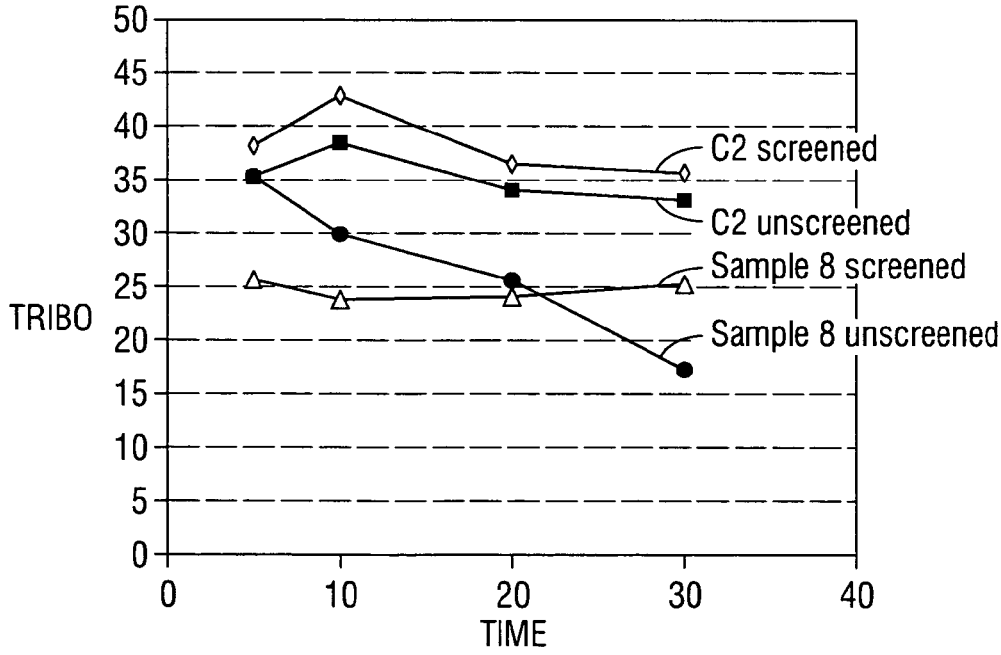
FIG. 8 is a graph comparing the triboelectric charge over time for screened and unscreened toner compositions of Sample 8 and Control 2.

The triboelectric properties of the toners were also examined. FIGS. 1 through 8 compare paint shake tribo tracks for the samples against a PMMA (polymethylmethacrylate) coated steel carrier to paint shake tribo tracks of the control samples. FIGS. 1 through 4 indicate that use of 1% concentrations of these friable additives alone provided similar charging behavior when compared to a fumed silica used as a control. The lone exception was the tribo track of the 02N additive, unscreened blend. FIGS. 5 though 8 indicate that use of these additives at 4% concentration in unscreened blends could adversely affect charging performance. Screened blends of 4% concentrations generally had satisfactory results. Thus, based on the physical observations and tribo tests, the use of friable additives in a toner composition without any additional additives can provide a toner with satisfactory triboelectric properties and offers better flow characteristics than conventional external additives.

Example II

Effect of Friable Additive on Toner Aging

Surrogate toner aging tests were conducted using the NANOGEL® Aerogel beads (used in Samples 1 and 2 of Example I) as a friable additive. Three black toners with different additive compositions were prepared. The toners were blended using the process described in Example I. The control toner (C3) included only a primary formed silica additive, 3.3% Degussa Ry-50 Silica. Sample 9 had the same external additive package as C3, except Sample 9 included a friable additive. Sample 9 included 1.65% RY-50 silica and 1.65% of the O1N NANOGEL® Aerogel Beads available from Cabot. Sample 10 included 3.3% of the O1N NANOGEL Aerogel Beads and had no RY-50 silica.

In the surrogate toner aging test, the toners were each artificially aged by mixing the toners, using a paint shaker, in a jar containing steel balls. The flow properties of the toners were determined using the cohesion test on the Hosokawa Powder test device, which is known in the art.

Figure 9:
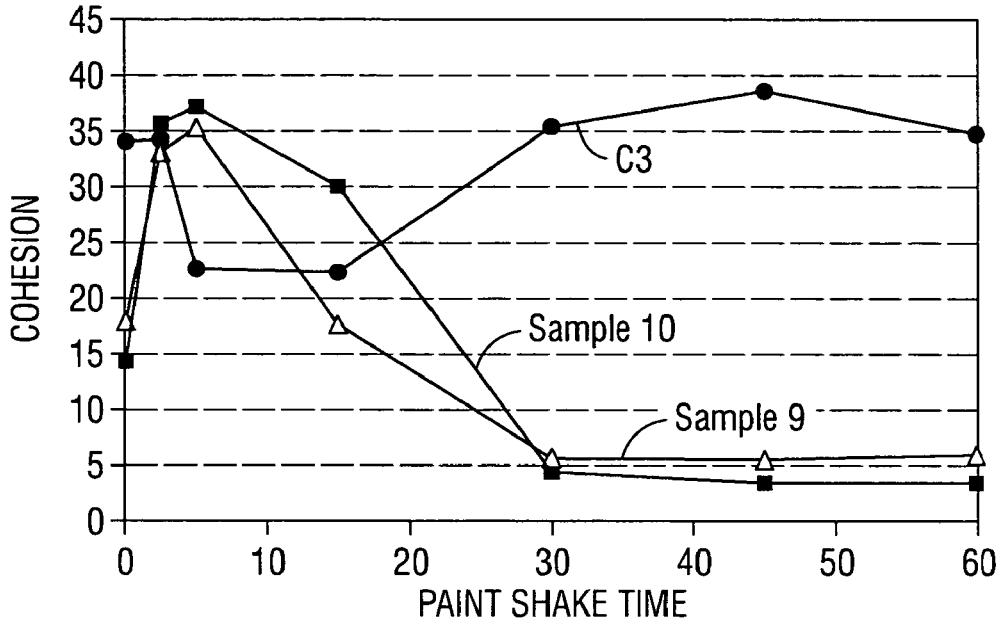
FIG. 9 is a graph comparing toners using a conventional external additive with toners using either 1) a combination of a friable additive and a conventional external additive or 2) a toner using a friable additive alone.

FIG. 9 shows the results of the aging test. High values of cohesion indicate higher cohesion and poorer toner flow properties. Thus, as seen in FIG. 9, over time, the toner with only the primary external silica additive exhibited higher cohesion than the toners that included either 1) a combination of a primary external additive and a friable additive, or 2) a friable additive alone. As shown by the examples and tests described herein, toner compositions comprising a combination of a primary external additive and a friable additive provide a toner composition that exhibits a longer effective life in that such compositions are able to exhibit, over time, excellent flow properties and satisfactory triboelectric properties compared to toners comprising only a primary external additive.

Example III

Effect of Friable Additive on Toner Tribo of Pilot Scale Blends

Toners were blended on the pilot plant scale using 2 NANOGEL® Aerogel materials (used in Samples 1, 2, 3 and 4 of Example I) as a friable additive. Five black toners with different additive compositions were prepared. The toners were blended using a 10 liter Henschel blender. A control toner, C3b, duplicated the additive package of toner C3 above. Samples 11 and 12 duplicated the additive package of Samples 9 and 10, respectively. Sample 13 included 1.65% RY-50 and 0.06% O2N NANOGEL® Fine Particle Aerogel available from Cabot. Sample 14 included 1.65% RY-50 and 1.65% O2N NANOGEL® Fine Particle Aerogel available from Cabot.

TABLE 3

| Sample # | % RY50 | % NANOGEL | Sample Code/Product Code |
|---|---|---|---|
| C3b | 3.3 | 0 | |
| 11 | 1.65 | 1.65/bead | O1N/OP0010 |
| 12 | 0 | 3.3/bead | O1N/OP0010 |
| 13 | 1.65 | 0.65/fine particle | O2N/OJ0008 |
| 14 | 1.65 | 1.65/fine particle | O2N/OJ0008 |

During screening after the blending operation, it was observed that a large portion of the bead type additive did not breakup enough during blending and was screened out. This was not the case of the fine particle samples. Analytical analysis of toner blends concurred with these observations. Sample 12 with the large bead NANOGEL® had only about ⅓ of the amount of silica additive inputted. Sample 11 was missing about ⅓ of the additive added. Chemical analysis of Samples 13 and 14 showed that almost all of the silica additives inputted survived the blending and screening steps.

Figure 10:
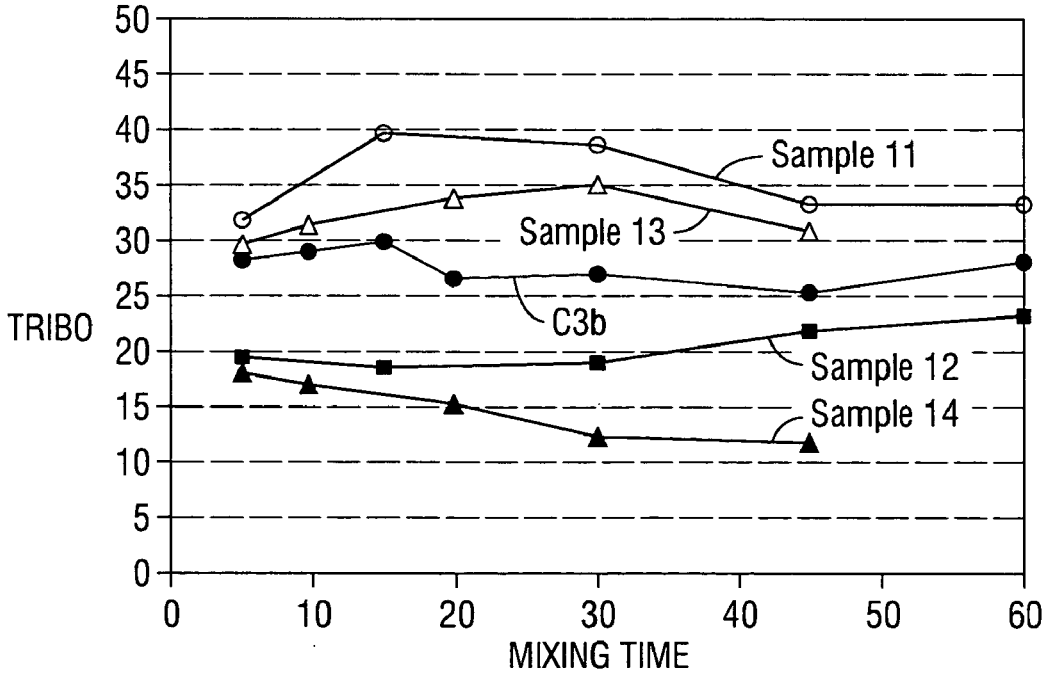
FIG. 10 is a graph showing the relationship between tribo and mixing time; and, FIG. 11 is a graph demonstrating cohesion over time.

The triboelectric properties of these toners were examined using a PMMA coated steel carrier. FIG. 10 compares the tribo of each blend versus the C3b control. In general, the lower concentrations of the NANOGEL® materials performed at least as well if not better triboelectrically as the control sample.

Example IV

Effect of Friable Additive on Toner Aging of Pilot Scale Blends

Figure 11:
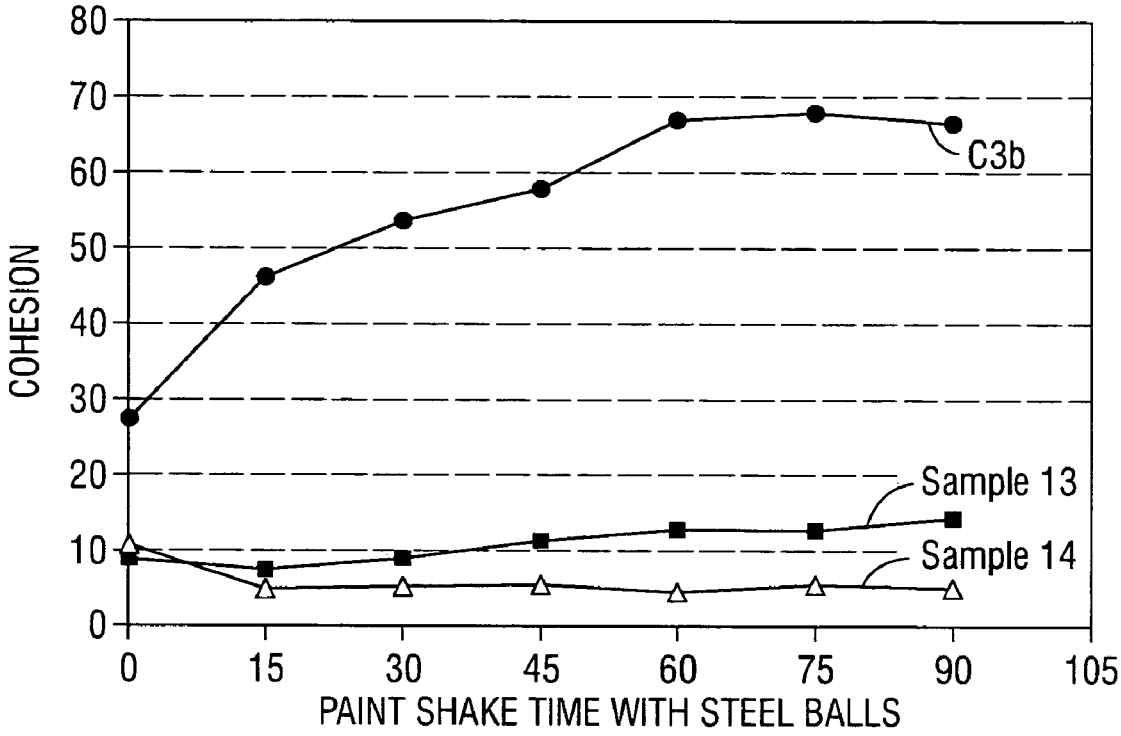

The surrogate toner aging tests were conducted again using the C3b, Sample 13 and Sample 14. The flow of the pilot plant toners having the friable additive was much better after 90 minutes of aging than the control C3b blend. See FIG. 11.

The exemplary embodiment has been described with reference to the specific embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A toner composition for an electrostatographic process, said toner comprising:

a toner particle;

a friable external additive which is a gel processed metal oxide selected from the group consisting of aerogels, silica-gels, xerogels, hydrogels, and combinations thereof; and an optional primary external additive whose particle size is less than the particle size of the friable external additive.

2. The toner composition of claim 1, wherein said friable external additive is present in an amount from greater than 0 to about 10% percent by weight of the toner composition.

3. The toner composition of claim 1, wherein said friable external additive and said primary external additive are present in the toner composition in about equal concentrations.

4. The toner composition of claim 1, wherein said friable external additive is present in an amount of from about 0.1 to about 10% percent by weight of the toner composition.

5. A developer for an electrostatographic process, said developer comprising:

a carrier; and a toner comprising a toner particle, an optional primary external additive, and a secondary external additive, wherein said secondary external additive is a friable external additive which is a gel processed metal oxide selected from the group consisting of aerogels, silica-gels, xerogels, hydrogels, and combinations thereof; and wherein the primary external additive has a particle size which is less than the particle size of the friable external additive.

6. The developer of claim 5, wherein said secondary external additive is present in an amount of about 0.1 to about 10 percent by weight of the toner.

7. A toner composition comprising:

a binder;

a colorant; and a combination of a primary surface additive and a friable surface additive, wherein said primary surface additive and said friable surface additive each exhibit a particle size, wherein said friable surface additive is a gel processed metal oxide selected from the group consisting of aerogels, silica-gels, xerogels, hydrogels, and combinations thereof; and the particle size of said friable surface additive is larger than the particle size of said primary surface additive.

8. The toner composition of claim 7, wherein said friable surface additive has a particle size of about 1 micron to about 5 mm.

9. The toner composition of claim 7, wherein the primary surface additive is a metal oxide selected from the group consisting of silica, alumina, ceria, germania, titania, zirconia, and mixtures thereof.

10. A method of forming a toner composition, comprising:

blending toner particles, a friable external additive, and an optional primary external additive to form the toner composition;

wherein the friable external additive is a gel processed metal oxide selected from the group consisting of aerogels, silica-gels, xerogels, hydrogels, and combination thereof; wherein the particle size of the optional primary external additive is less than the particle size of the friable external additive; and wherein after blending, the friable external additive remains friable.

11. The method of claim 10, wherein the friable surface additive has a particle size of from about 500 nanometers to about 1 mm.

12. The toner composition produced by the method of claim 10.

13. The toner composition of claim 1, wherein the friable external additive has a particle size of from about 500 nanometers to about 8 microns.

14. The toner composition of claim 1, wherein the friable external additive has a particle size of about 8 microns.

15. The toner composition of claim 1, wherein the toner particle has a volume median diameter of from about 6 to about 12 microns and the friable external additive has a particle size of about 8 microns.

16. The toner composition of claim 5, wherein the friable external additive has a particle size of from about 500 nanometers to about 8 microns.

17. The toner composition of claim 5, wherein the friable external additive has a particle size of about 8 microns.

18. The toner composition of claim 7, wherein the friable external additive has a particle size of from about 500 nanometers to about 8 microns.

19. The toner composition of claim 7, wherein the friable external additive has a particle size of about 8 microns.

20. The toner composition of claim 7, wherein the toner particle has a volume median diameter of from about 6 to about 12 microns and the friable external additive has a particle size of about 8 microns.

* * * * *